52-57
10/15/85 OF 4,546,577

United States Patent [19]

Gerhaher et al.

[11] Patent Number: 4,546,577

[45] Date of Patent: Oct. 15, 1985

[54] RIDGE TILE

[76] Inventors: Max Gerhaher, Dr.Aicher-Str. 3, 383 Landau/Isar; Franz Gerhaher, Stadtgraben 20, 844 Straubing, both of Fed. Rep. of Germany

[21] Appl. No.: 500,353

[22] Filed: Jun. 2, 1983

[30] Foreign Application Priority Data

Jun. 4, 1982 [DE] Fed. Rep. of Germany ..... 3221142

[51] Int. Cl.[4] ..... E04B 7/00

[52] U.S. Cl. ..... 52/57; 52/277; 52/465; 52/537

[58] Field of Search ..... 52/57, 277, 465, 58, 52/537, 533, 302

[56] References Cited

U.S. PATENT DOCUMENTS 3,694,982 10/1972 Gerhaher .

FOREIGN PATENT DOCUMENTS 14422 of 1928 Australia ..... 52/277
6145 of 1904 United Kingdom ..... 52/57
1574826 9/1980 United Kingdom ..... 52/57

OTHER PUBLICATIONS

DIN 4108 "Warmeschutz im Hochbau", (Heat Insulation in Buildings Above the Ground), Part 3, Moisture Protection in Dependence on Climate.

*Primary Examiner*—John E. Murtagh
*Assistant Examiner*—Kathryn Ford
*Attorney, Agent, or Firm*—Fleit, Jacobson, Cohn & Price

[57] ABSTRACT

This invention relates to a ridge tile which defines a ventilating gap between the outside surface of that end portion of the tile which is overlapped in the roof and the inside surface of the overlapping end portion of the adjacent ridge tile in that its end portion which is overlapped in the roof has a flat surface and the lower portions of the outside surface of its overlapped end portion define a clearance with the inside surface of the overlapping end portion of the adjacent ridge tile. It is an object of the invention to provide a ventilating ridge tile which is of the kind defined first hereinbefore and together with an adjacent ventilating ridge tile of the same kind defines a larger effective ventilating cross-sectional area whereas the external size and shape of the ventilating ridge tile are substantially preserved and the universal usability of the ventilating ridge time in a mortar bed or with unbonded joints on roof pane tiles or ridge-adjoining tiles is obstructed or reduced. This is accomplished in that the overlapped end portion of the ridge tile is provided with additional, outwardly sloping, flat surfaces between the surface at the apex of the tile and those portions which define a clearance with the adjacent ridge tile.

9 Claims, 5 Drawing Figures

Figure 1:
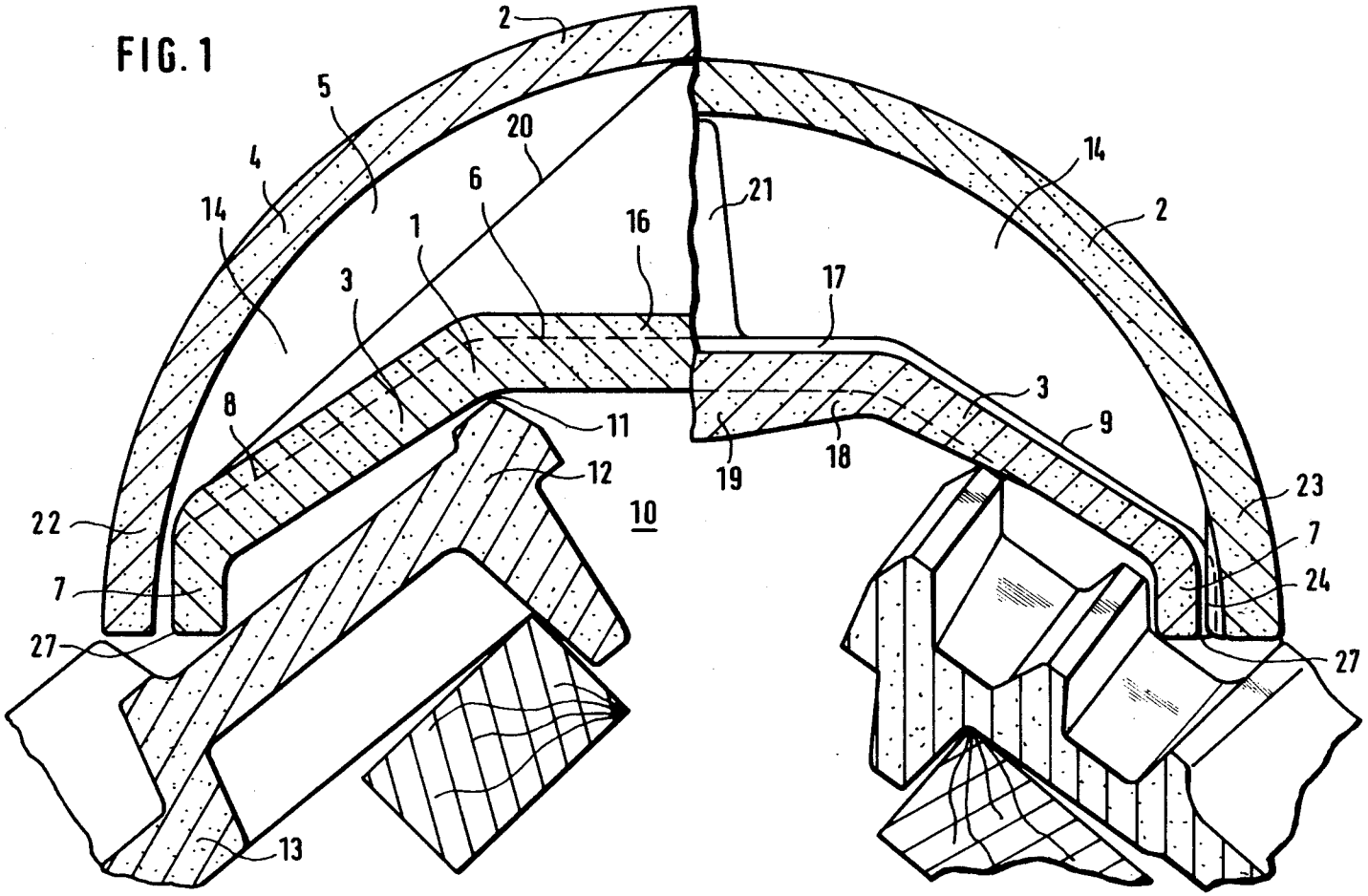

25
26

RIDGE TILE

This invention relates to a ridge tile which defines a ventilating gap between the outside surface of that end portion of the tile which is overlapped in the roof and the inside surface of the overlapping end portion of the adjacent ridge tile in that its end portion which is overlapped in the roof has a flat surface and the lower portions of the outside surface of its overlapped end portion define a clearance with the inside surface of the overlapping end portion of the adjacent ridge tile.

Ridge tiles of the above-mentioned kind are known from German Patent Specifications Nos. 19 49 355 and 19 55 924 and these provide per lineal meter only a restricted ventilating cross-sectional area. Ventilating cross-sectional areas equal to 0.5 o/o of the associated roof surface area are called for in DIN 4108 "Wärmeschutz für Hochbau" (Heat Insulation in Buildings Above the Ground), Part 3, "Moisture Protection in Dependence on Climate", and can be obtained with ventilating ridge tiles of conventional size only if the rafters have a length not in excess of about 6 meters. This means that in a pitched roof having a rafter length of 2×6 meters, the ventilating cross-sectional area at the ridge must amount to about 60 $cm^2$ per lineal meter of the ridge. This can be achieved with the known ridge tiles mentioned above. With longer rafters, conventional ventilating dormers or ventilating tiles adjoining the ridge must be included in the roof; these roofing elements cost five to ten times as much as a normal roofing tile so that they greatly increase the costs of a roof having long rafters.

The use of ventilating ridge tiles which are known from the above-mentioned patent specifications and are distinctly wider than the conventional ridge tiles is not desired for reasons of appearance and for reasons of manufacturing and application technology. As a result, the ventilating cross-sectional area per pair of ridge tiles or per lineal meter can be increased only to a very restricted extent and this will involve great disadvantages.

Besides, it is not desirable to provide ventilating ridge tiles which are of the kind known from the above-mentioned patent specifications and have a length which is smaller than the conventional covering length of conventional ridge tiles, amounting to 33 cm. The use of such short ventilating ridge tiles would require a larger number of ridge tiles and would involve much higher costs. It must be borne in mind that the comparable ridge tiles account for about 10% of the total costs of roof tiles.

It is an object of the invention to provide a ventilating ridge tile which is of the kind defined first hereinbefore and together with an adjacent ventilating ridge tile of the same kind defines a larger effective ventilating cross-sectional area whereas the external size and shape of the ventilating ridge tile are substantially preserved and the universal usability of the ventilating ridge time in a mortar bed or with unbonded joints on roof pane tiles or ridge-adjoining tiles is obstructed or reduced.

This object is accomplished in that the overlapped end portion of the ridge tile is provided with additional, outwardly sloping, flat surfaces between the flat surface at the apex of the tile and those portions which define a clearance with the adjacent ridge tile. The advantage afforded by the ridge tile in accordance with the invention resides in that the additional sloping flat surfaces provide an additional ventilating cross-sectional area whereas the clearance defined by the underside of the overlapped end portion of the ridge tile in the region in which the top of a steep roofing tile contacts the ridge tile is not restricted.

A further improvement within the scope of the invention can be achieved in that that end portion of the ridge tile which is overlapped in the roof has beside its end face a rib or an at least partly externally extending peripheral groove. That groove will ensure a draining of rainwater or melted water to the roof surface across the edge portions on opposite sides. The effective ventilating cross-sectional area can be further increased in that the rib is omitted entirely or in part.

A further improvement within the scope of the invention can be achieved in that that end portion of the ridge tile which is overlapped in the roof has beside its end face an inwardly and/or downwardly protruding stiffening rib, which extends entirely or partly around the periphery of the tile. Such stiffening rib will afford the advantage that it stiffens the end portion of the ridge tile to such a degree that the tile may be thinner so that the ventilating cross-sectional area is further increased and the need for the peripheral external rib, which would reduce the ventilating cross-sectional area, and the need for the stiffening action of such rib, may be eliminated.

A further improvement of the ridge tile defined in the foregoing paragraph can be achieved in that the stiffening rib is higher in its intermediate portion than in its remaining portions. The advantage afforded by that preferred embodiment resides in that the bending stiffness and the ultimate stress of the particularly highly stressed and endagered intermediate portion is greatly increased whereas the height of the clearance on the underside of the outer portions is not substantially restricted. The ultimate stress of a ridge tile is not only significant in the roof but the stiffness of the molded tile which is still soft is also significant in connection with manufacturing tolerances and the proportion of broken tiles.

Within the scope of the invention, a ridge tile may have an overlapped end portion which adjacent to the end face of the overlapping end portion of the adjacent ridge tile is shaped like a pitched roof in cross-section and at its apex constitutes a support for the overlapping end portion of the adjacent ridge tile. Such ridge tiles are known per se from the above-mentioned German Patent Specification No. 19 55 924. Within the scope of the invention, said end portion of the ridge tile may comprise a portion which has the shape of a steep pitched roof and preferably consists of a steep stiffening rib. The advantage afforded by such ridge tiles resides in that there will be no obstructing constriction of the ventilating cross-section at the transition from the simple horizontal ventilating cross-section to the separate ventilating cross-sections disposed on opposite sides on the left and right side of the portion which is similar to a pitched roof.

A further improvement of the ridge tile will be achieved in that its end portion which overlaps in the roof has at its lower portions a rib, which extends into the peripheral groove of the overlapped end portion of the adjacent ridge tile. An advantage afforded by such a ridge tile resides in that adjacent ridge tiles lock each other against a movement in the longitudinal direction without a need for additional ribs on the outside surface of the overlapped end portion.

A further improvement is achieved in that end portion of the ridge tile which overlaps in the roof has a height which exceeds one-half of the width of said ridge tile. An advantage afforded by said feature resides in that the cross-sectional area of the overlapped end portion of the ridge tile is not changed and its external shape is not substantially changed but the effective ventilating cross-sectional area defined by two adjacent ridge tiles is substantially increased.

The improvements which may be adopted within the scope of the invention and have been described hereinbefore result in a doubling of the ventilating cross-sectional area without additional costs being incurred. As a result, the pemissible rafter length on each side of a pitched roof is increased to about 13 meters.

The ventilating cross-sectional area per lineal meter of the ridge can be substantially increased further in that the covering length of the ridge tile is less than four-thirds of the overall width of the ridge tile. This feature will not involve a change of the cross-section of the tile. This decrease of the length of the ridge tile will result in a further increase of the ventilating cross-sectional area per lineal meter of the ridge but will involve additional costs.

Figure 2:
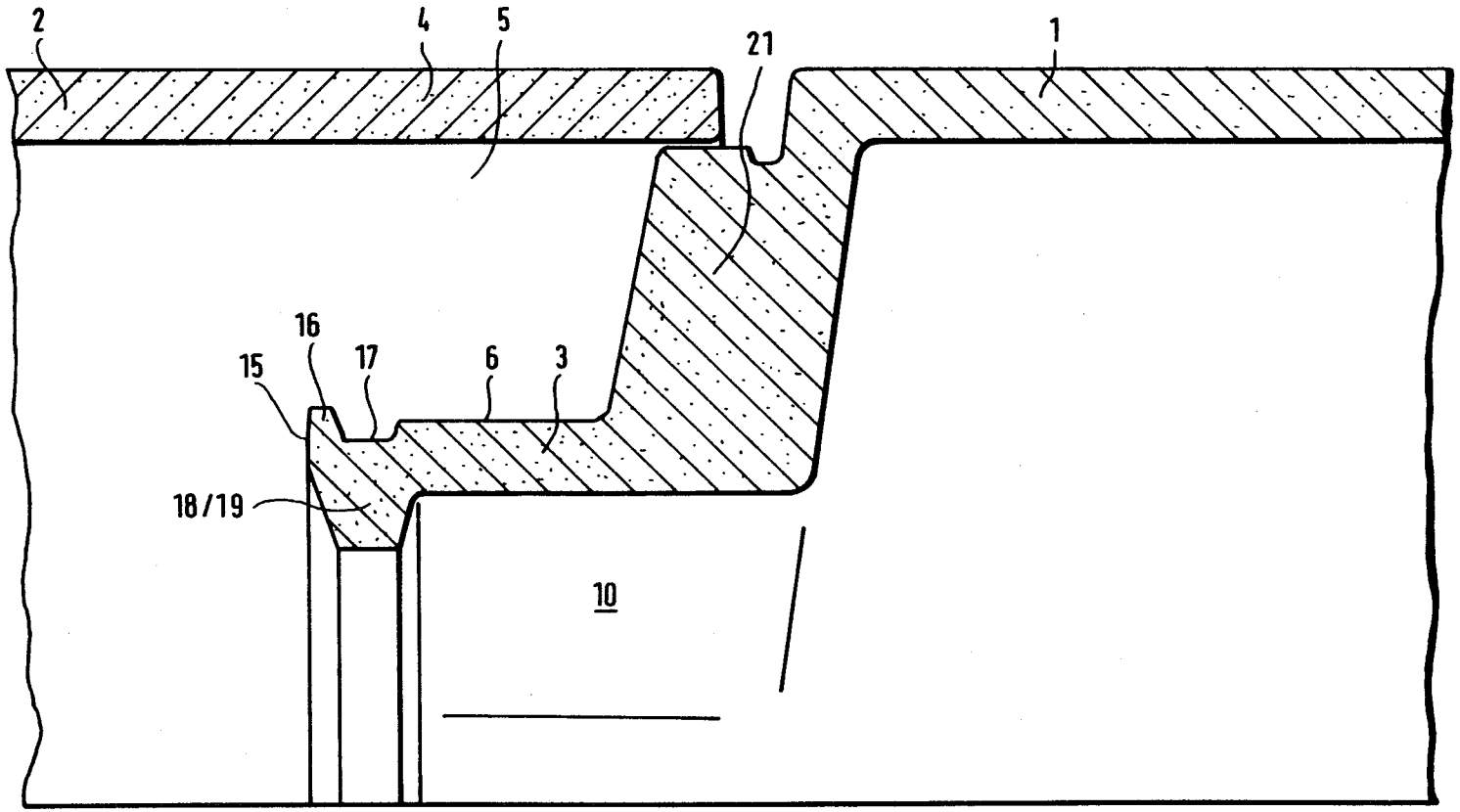
Figures 3A, 3B:
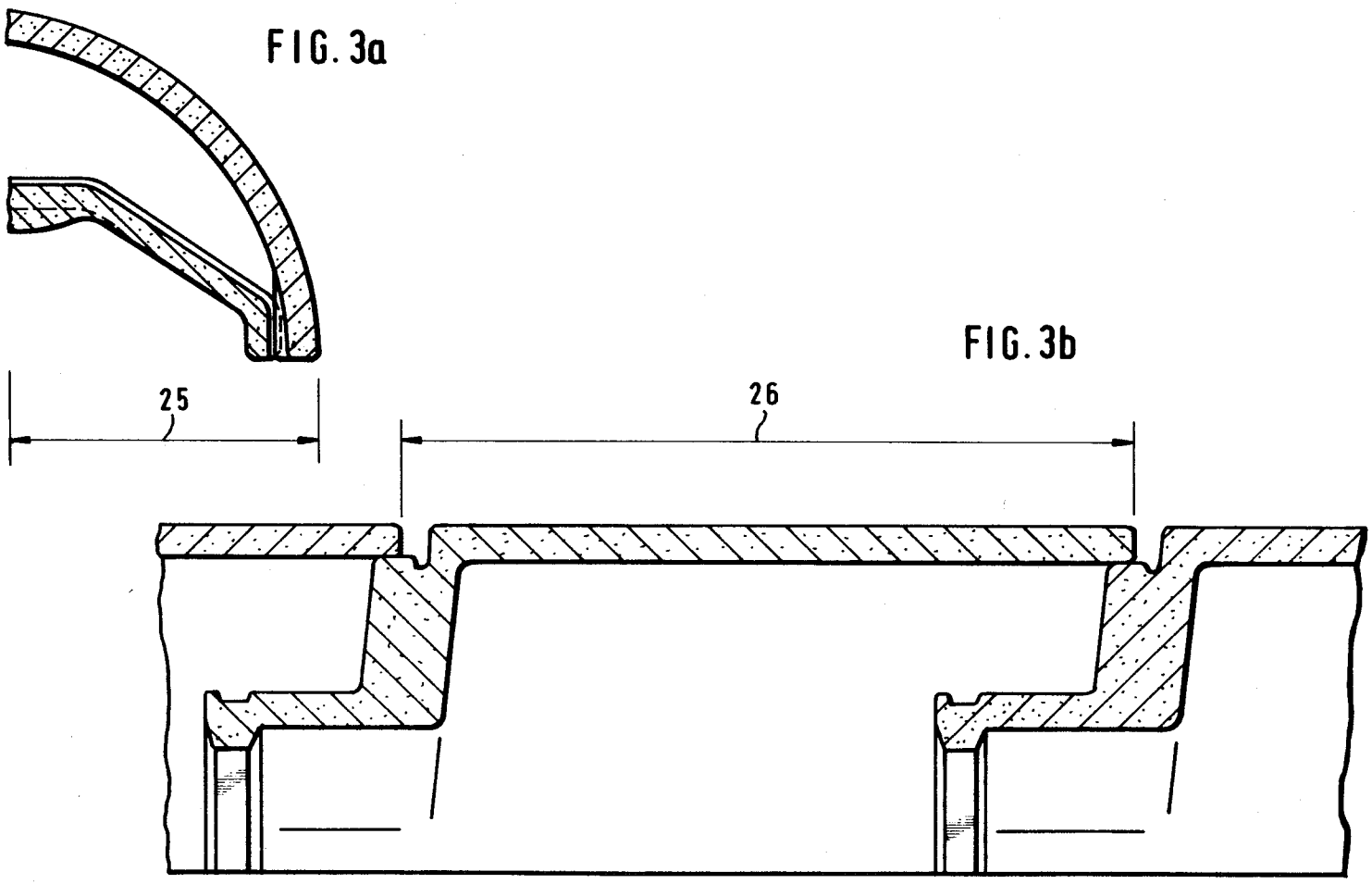

Illustrative embodiments of the ridge tile according to the invention will be explained more in detail hereinafter with reference to the drawing, in which FIG. 1 is a transverse sectional view showing two overlapping end portions of two ridge tile embodying the invention, wherein the ridge tiles shown in the left-hand and right-hand halves of FIG. 1 represent different embodiments of the invention, FIG. 2 is a longitudinal sectional view taken on the center line of FIG. 1 and showing a ridge tile, FIG. 3*a* is a transverse sectional view showing one-half of two overlapping end portions, and FIG. 3*b* is a longitudinal sectional view showing three overlapping tidge tiles.

Figure 4:
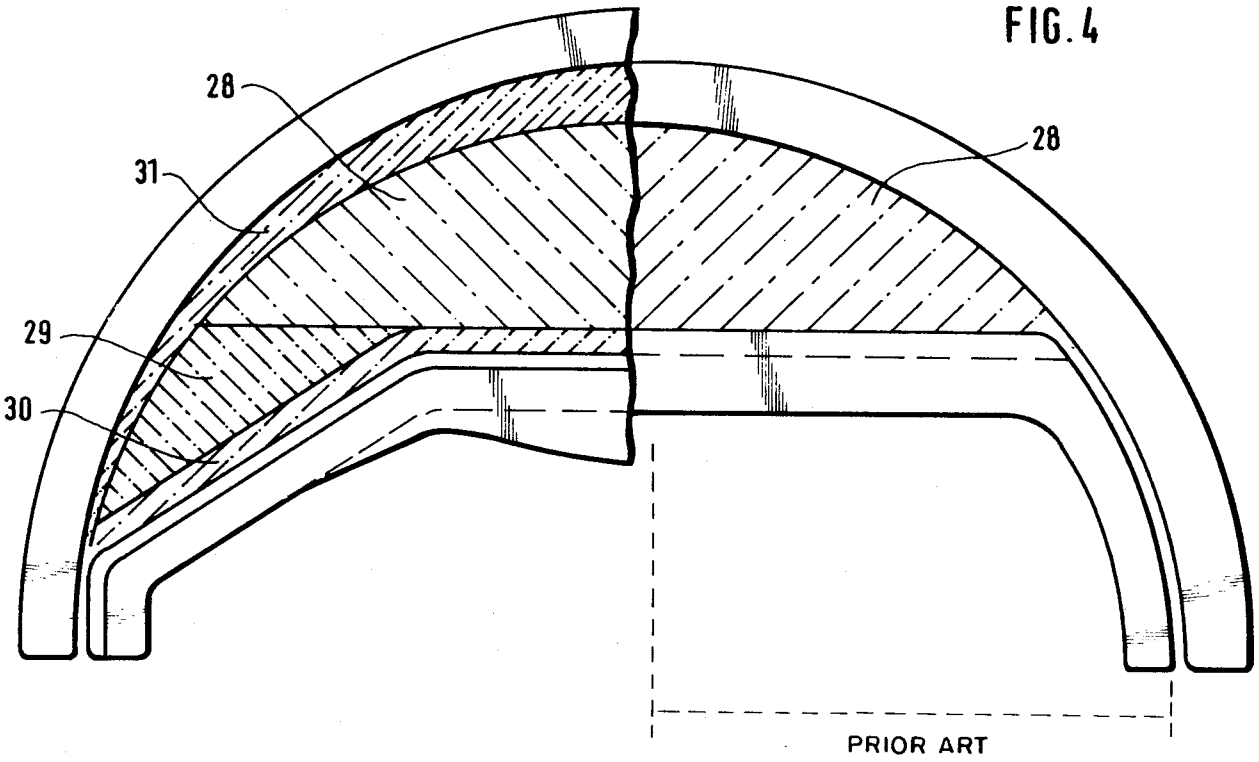

FIG. 4 is a transverse sectional view showing two overlapping end portions of ridge tiles. The original ventilating cross-section of the known ridge tile is shown in the right-hand half and the larger ventilating cross-section defined by the ridge tile embodying the invention is shown in the left-hand half.

FIGS. 1 and 2 show the mutually overlapping portions of two ridge tiles 1, 2. The ridge tile 1 defines a ventilating gap 5 between the outside surface of its end portion 3 which is overlapped in the roof and the inside surface of the overlapping end portion 4 of the adjacent ridge tile 2. This is due to the fact that that end portion 3 of the ridge tile 1 which is overlapped in the roof has at its apex a flat surface 6. The lower portions 7 of the outside surface of the overlapped end portion 3 of the ridge tile 1 define a clearance with the inside surface of the overlapping end portion 4 of the adjacent ridge tile 2. The overlapped end portion 3 of the ridge tile 1 is provided with additional outwardly sloping flat surfaces 8, 9 between its flat surface 6 at the apex and those portions which define a clearance with the adjacent ridge tile 2. One end of each sloping flat surface 8, 9 is located adjacent to one of the lower portions 7 and the inside surface of adjacent ridge tile 2. The other end of each sloping flat surface 8, 9, is located adjacent to one end of flat surface 6 and is spaced a substantial distance from the inside surface of the adjacent ridge tile 2. The ventilating air space between the overlapped end portion and the inside surface of the adjacent ridge tile 2 is thereby increased. As a result, an additional ventilating cross-sectional area 14 is defined by the laterally outwardly sloping, flat surfaces 8, 9 in the region 11, in which the top 12 of a covered steep roofing tile 13 contacts the ridge tile. The lower clearance 10 defined by the overlapped end of the ridge tile 2 is not restricted thereby.

The ridge tile 1 is provided on that end portion 3 which is overlapped in the roof with a rib 16, which is disposed beside the end face 15 of said end portion and which may be omitted entirely or in part if it is replaced by a peripheral groove 17, in which any rainwater or melted water can drain to the roof surface across the edges 27 disposed on opposite sides. The ventilating cross-sectional area 14 will be further increased by the omission of the rib 16. To stiffen the overlapped end portion 3, an inwardly protruding rib 18, is suitably provided, which has a larger height in its intermediate portion 19. This will ensure that the clearance 10 will not be excessively restricted in the region 11 in which the tops 12 of covered steep roofing tiles 13 preferably contact the ridge tile 1. But the portion 20 which has the shape of a pitched roof may be much steeper than is known in the art and in an extreme case may consist of a central supporting rib 21. The ridge tiles 1, 2 lock each other against longitudinal movement by means of the ribs 24, which are provided adjacent to the lower end portions 22, 23 of the overlapping end portion 4 and extend into the groove 17 of the overlapped end portion 3.

FIG. 3*a* is a transverse sectional view showing one-half 25 of the total width of a ridge tile. FIG. 3*b* is a longitudinal sectional view showing the covering length 26.

FIG. 4 shows in its right-hand half the original ventilating cross-section 28 defined by a ridge tile of the prior art acknowledged hereinbefore; that cross-sectional area is considered to amount to 100% for comparison. In the left-hand half, the original ventilating cross-sectional area 28 and the additional ventilating cross-sectional areas 29, 30 and 31 provided as a result of the improvements described hereinbefore are represented. The ventilating cross-sectional area 29 is due to the sloping of the lateral portion and results in an increase of about 39%. The ventilating cross-sectional area 30 is due to the groove 17 and corresponds to an increase of about 23%. The ventilating cross-sectional area 31 is due to the larger height of the overlapping end portion and results in an increase of about 39%.

The total increase of the ventilating cross-sectional area which can be achieved exceeds 100% whereas the total width, the required clearance space 10 and the entire outer appearance of the ventilating ridge tile have not been changed.

What is claimed is:

1. A ridge tile comprising:

an elongated body having a forward end and a rearward end, said rearward end intended to be overlapped by a forward end of a similar ridge tile in a mating relationship, a first portion defined by a flat surface located at an apex of the edge of said rearward end, and said first portion being spaced from an overlapping tile opposing sides defined by said rearward end, said opposing sides being positionable adjacent to the forward end of the overlapping ridge tile, second portions defined by flat surfaces located at the edge of said rearward end, said second portions being outwardly sloped from said first portion and extending towards said opposing sides, and one end of each second portion being located adjacent to one of said opposing sides and adjacent to the forward end of the overlapping ridge tile and the other end of each second portion being located adjacent to one end of said first portion and spaced a substantial distance from the forward end of the overlapping ridge tile to thereby provide an increased ventilating air space between said rearward end and the forward end of the overlapping ridge tile.

2. A ridge tile as claimed in claim 1, further comprising a rib defined by at least a portion of the outer periphery of said rearward end and projecting outwardly to engage the forward end of the the overlapping ridge tile.

3. A ridge tile as claimed in claim 1, further comprising a groove defined by at least a portion of the outer periphery of said rearward end to engage the forward end of the overlapping ridge tile.

4. A ridge tile as claimed in claim 1, further comprising a stiffening rib extending from at least a portion of the inner periphery of said rearward end.

5. A ridge tile as claimed in claim 4, wherein said stiffening rib is highest in a central region of the inner periphery of said rearward end.

6. A ridge tile as claimed in claim 1, further comprising a supporting rib defined by said rearward end extending outwardly from the periphery of said rearward end to form a support for the forward end of the overlapping ridge tile.

7. A ridge tile as claimed in claim 3, further comprising a rib defined by the inner periphery of said rearward end for engaging a groove of the forward end of the overlapping ridge tile.

8. A ridge tile as claimed in claim 1, wherein the height of the rearward end is greater than one-half its width.

9. A ridge tile as claimed in claim 1, wherein the length of said forward end is less than four-thirds its width.

* * * * *